US005699093A

United States Patent [19]

Alderson

[11] Patent Number: 5,699,093

[45] Date of Patent: Dec. 16, 1997

[54] INK JET PRINT HEAD

[75] Inventor: Richard K. Alderson, Phoenix, Ariz.

[73] Assignee: HSLC Technology Associates Inc, Scottsdale, Ariz.

[21] Appl. No.: 957,932

[22] Filed: Oct. 7, 1992

[51] Int. Cl.[6] ..... B41J 2/04; B41J 2/17

[52] U.S. Cl. ..... 347/54; 347/94

[58] Field of Search ..... 346/140 R; 347/55, 347/54, 61, 40, 94

[56] References Cited

U.S. PATENT DOCUMENTS

| | | | |
|---|---|---|---|
| 2,071,967 | 2/1937 | Bungner | 234/1.5 |
| 3,177,800 | 4/1965 | Welsh | 101/1 |
| 3,640,214 | 2/1972 | Scheinutte | 101/45 |
| 3,832,579 | 8/1974 | Arndt | 310/8.1 |
| 4,233,610 | 11/1980 | Fischbeck et al. | 347/94 |
| 4,347,524 | 8/1982 | Engel et al. | 347/94 |
| 4,528,578 | 7/1985 | Balbo | 347/94 |
| 4,528,579 | 7/1985 | Brescia | 347/94 |
| 4,559,543 | 12/1985 | Toganoh et al. | 347/32 |
| 4,577,202 | 3/1986 | Hara | 347/64 |
| 4,587,528 | 5/1986 | Beaudet | 346/75 |
| 4,595,937 | 6/1986 | Conta et al. | 347/55 |
| 4,686,544 | 8/1987 | Ikeda et al. | 347/64 |
| 4,719,477 | 1/1988 | Hess | 347/59 |
| 4,841,310 | 6/1989 | Hoffman | 347/94 |
| 4,905,019 | 2/1990 | Vonasek | 347/94 |
| 5,021,809 | 6/1991 | Abe et al. | 347/94 |
| 5,040,074 | 8/1991 | Stemmle | 358/296 |
| 5,079,571 | 1/1992 | Eriksen | 347/43 |

FOREIGN PATENT DOCUMENTS

| | | | |
|---|---|---|---|
| 4-269547 | 9/1992 | Japan | 346/75 |

*Primary Examiner*—Huan N. Tran
*Assistant Examiner*—Craig A. Hallacher
*Attorney, Agent, or Firm*—Quarles & Brady

[57] ABSTRACT

A head for an ink jet printer has a substrate with a longitudinal dimension extending across the width of the paper to be printed upon. A cavity is formed longitudinally in the substrate and a conduit is provided to supply ink to the cavity. A series of orifices are spaced along a longitudinal surface of the substrate and extend between the surface and the cavity. A plurality of electrodes are provided to generate an arc within each orifice to expel ink there from. A pair of electrodes are associated with each orifice and the electrodes connect to electrical buses that supply bias voltage to the electrodes. The bus connection multiplexes the electrodes enabling relatively few switches to selectively control the expulsion of ink from each orifice. A diaphragm lies against the substrate forming a wall of the cavity and of the orifices. The diaphragm is formed of a resilient material that dampens pressure waves produced within an orifice and the cavity when an arc occurs between electrodes for that orifice.

17 Claims, 2 Drawing Sheets

FIG. 1
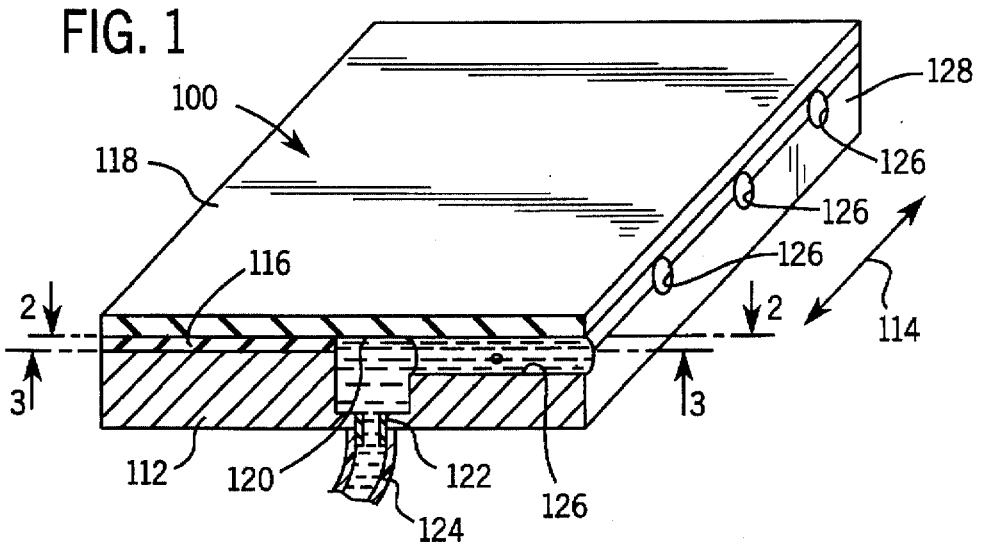
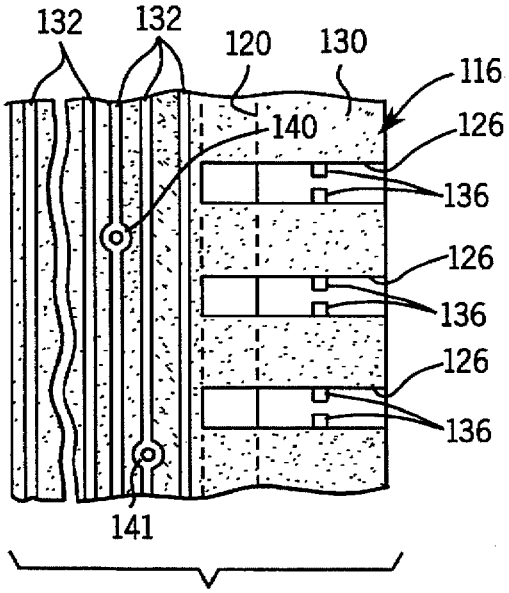
FIG. 2
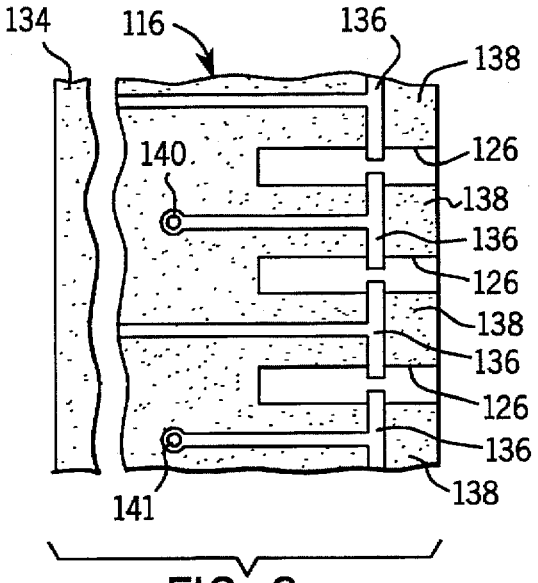
FIG. 3
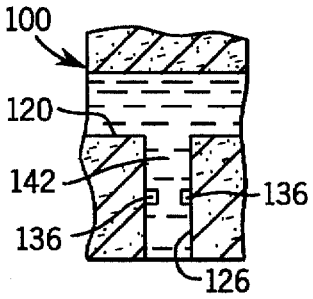
FIG. 4A
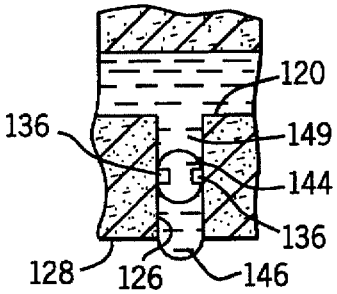
FIG. 4B

INK JET PRINT HEAD

BACKGROUND OF THE INVENTION

The present invention relates to ink jet type printers for computers, and more particularly to the printing heads for such devices.

Various types of printers have been devised for converting computer and word processor information into human readable form on a piece of paper. One class of such devices is referred to as ink jet printers in which droplets of ink are ejected from a print head toward the paper to create a pattern of dots that form each printed character. Conventional print heads have one or more vertical lines of apertures as high as a line of printed text and a liquid ink supply coupled to the apertures. Associated with each aperture is a mechanism that is selectively energized to heat the ink to its vaporization temperature. As the ink vaporizes, the pressure increases dramatically forcing a droplet of ink out of the aperture toward an adjacent piece of paper. Two common techniques are utilized to vaporize the ink within the apertures. One involved placing resistive heating elements adjacent the aperture to heat the ink to its vaporization temperature. A second technique creates an electrical arc between two electrodes within the aperture which vaporized the ink.

The vertical array of apertures was sized so as to be able to print the vertical dimension of characters on a given line of text in much the same way a dot matrix print head has a one-dimensional array of pins which strike a ribbon to print a character. A two-dimensional character was formed by moving the print head across the width of the paper in order to print a full horizontal line of text. To print the next line, the paper was moved vertically by either a tractor feed mechanism or pinch rollers. While the paper was being advanced vertically, the print head often returned to the original side of the paper to print another line of text, from left to right for example. In order to speed up the printing process, bi-directional printers were devised in which the print head would print adjacent lines in opposite directions of travel, thereby eliminating the need for the head to always return to the same side of the paper before beginning a new line.

Even with bi-directional printers, the computer was able to feed data to the printer at a faster rate than it was able to be printed onto the paper. This required the user to wait while the computer was printing a document before the computer could be used for other tasks. Therefore, there is a need for increasing the speed at which printers produced pages of text.

SUMMARY OF THE INVENTION

An ink jet print head for printing on paper includes a body the length of which is as great as one dimension of the paper so as to be able to print across that dimension of the paper. The body has a trough-like groove and a plurality of orifices that communicate between the groove and a surface of the body. A conduit is provided to supply ink to the groove.

A plurality of electrodes are arranged so that ends of two different electrodes lie within each orifice. In the preferred embodiment the electrodes are connected to a smaller plurality of electrical buses to apply selected bias voltages to the electrodes. The pattern in which the electrodes are connected to the buses provides a multiplexing mechanism by which a relatively small number of switches are able to control the voltage applied to a greater number of electrodes to generate arcs in selected apertures. In the version of the present invention being described herein, the plurality of electrical signal buses are divided into a first group of X buses to which one set of electrodes connect and into a second group of Y buses to which another set of electrodes connect, where X and Y are integers. In this case, each electrical signal bus in the first group is connected to every Xth electrode in the one set, and each electrical signal bus in the second group is connected to every other electrode in a subset of X electrodes in the other set.

A diaphragm is coupled to the body thereby covering the trough and/or the grooves. The diaphragm is formed of a resilient material that dampens pressure waves produced within a groove and the trough when an arc is generated between the electrodes within that groove.

BRIEF DESCRIPTION OF THE DRAWINGS

FIG. 1 is a perspective view of a print head according to the present invention;

FIG. 2 is a cross-sectional view taken along line 2—2 of FIG. 1;

FIG. 3 is a cross-sectional view taken along line 3—3 of FIG. 1;

FIGS. 4A–4D are cross sections through a print head aperture in different stages of the printing process.

DETAILED DESCRIPTION OF THE INVENTION

Figure 5:
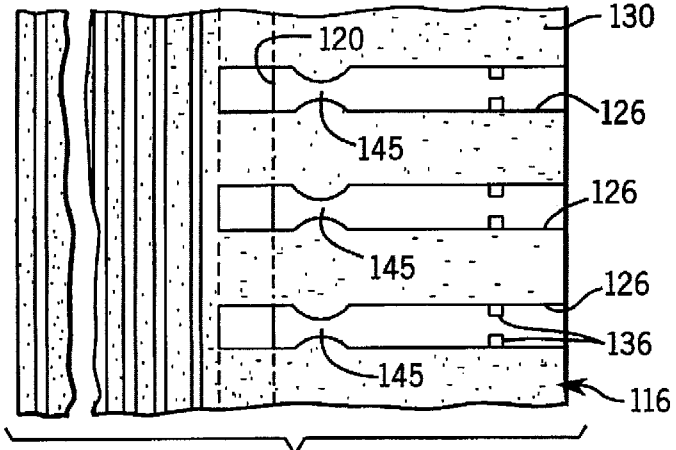
FIG. 5 is a cross-sectional view taken along line 2—2 of FIG. 1 of another embodiment of the print head.

Referring initially to FIG. 1, an ink jet print head 100 has a generally rectilinear shape and a length along direction 114 sufficient to extend across the width of a sheet of paper on which printing is to occur. The print head is a laminated structure formed by a substrate 112, an dielectric sheet 116 and an elastomeric diaphragm 118. The substrate is formed of a electrical insulating material or metal with an insulating surface coating. An ink rail 120 is formed by a cavity that extends longitudinally inside the print head along direction 114. At some point along the length of the ink rail 120, an opening 122 is created through which ink can be supplied from a reservoir via a tube 124. Alternatively the ink rail 120 can be enlarged to serve as a self contained ink reservoir with the entire head 100 being replaced when the ink is used up.

A plurality of orifices 126 extend from one surface 128 of the print head to the ink rail 120. The orifices 126 are spaced periodically along the print head with approximately 400 orifices per inch along direction 114, for example. Thus, a print head for an 8.5 inch wide sheet of paper would have 3,400 orifices along its length. Although the orifices 126 are shown located on a longitudinal line on the one surface 128, they can be positioned in a zigzag manner to enable closer spacing of the orifices. Ink from the ink rail 120 flows into each orifice by capillary action. A slight negative pressure prevents the ink from flowing out of the orifice at surface 128.

The ink rail 120 and orifices 126 are defined by a trough-like groove pattern formed in the substrate 112, and by the shape of the dielectric sheet 116 and the diaphragm 118. As shown in FIG. 2, the dielectric sheet 116 is formed of a non-conductive, dielectric material such as a plastic or ceramic and has notches which define a portion of each orifice 126. The dielectric sheet 116 has a first surface 130 which is remote from the substrate 112. Electrically conductive material is deposited on the first surface 130 to form electrical conductive buses 132 that extend the full length of the print head, parallel to the ink rail 120. As will be described, the buses 132 connect to the output of electrode driver circuits which selectively apply different bias voltages to the conductors in order to expel ink from selected orifices 126.

FIG. 3 illustrates a portion of a second surface 134 of the dielectric sheet 116 which is adjacent the substrate 112. A plurality of electrodes 136 are formed by depositing electrically conductive material on the second surface 134. Each of the electrodes 136 has a generally T-shape and is positioned on a finger 138 of the sheet 116 which is between two adjacent orifices 126. The cross member of each T-shaped electrode 136 extends between two adjacent orifices 126 with the ends of the cross member projecting into the associated orifices. An elongated member of each electrode 136 connects the cross member to a plated through orifice, such as orifices 140 and 141, that electrically interconnects the electrode with one of the electrical buses 132 on the first surface 130. This interconnection applies the bias potential from one of the electrical buses 132 to each of the electrodes 136. As will be described, the magnitude of this bias potential is varied to eject droplets of ink from selected orifices 126 along the print head. Although common T-shaped electrodes for adjacent orifices 126 are illustrated, separate electrodes could be utilized for each orifice.

Figure 4D:
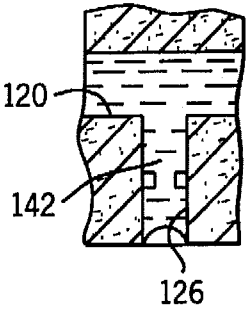
Figure 4C:
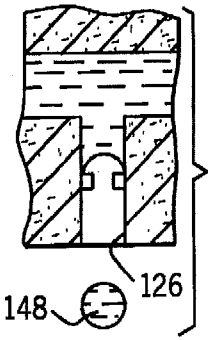

The process by which a droplet of ink is ejected from one of the orifices 126 is sequentially illustrated in FIGS. 4A–4D. Beginning with FIG. 4A, an electric pulse between 150 and 250 volts is applied across electrodes 136 in the selected orifice 126 which creates an arc in the ink 142 between the electrodes. The bias voltage on the electrodes 136 can then be reduced to 40–60 volts in order to sustain the arc. The arc vaporizes the ink in the vicinity of the electrodes 136 creating a vapor bubble 144 as shown in FIG. 4B. The bubble pushes outward a portion 146 of the ink between the electrodes 136 and the print head surface 128. As the vapor bubble 144 continues to expand, a droplet of ink 148 is ejected from the orifice 126, as illustrated in FIG. 4C. This droplet 148 is propelled toward the sheet of paper (not shown) where it impacts the surface of the paper and spreads out creating an ink dot. The combination of ink dots generated by a series of ink droplets 148 form the character on the paper as the paper feeds past the print head. After the droplet has been expelled, the ink vapor condenses. The voltage across the electrodes 136 in the orifice is reduced and the orifice once again fills with ink 142 from the ink rail 120, as shown in FIG. 4D.

When a vapor bubble forms in an orifice 126 as shown in FIG. 4B, the pressure also increases in region 149 between the electrodes 136 and the ink rail 120. This pressure wave often travels though the ink which can cause ink to be ejected from adjacent orifices even though an arc was not created in those orifices. To prevent such spurious ejection of ink, the upper surfaces of the orifices 126 and/or the ink rail 120 are formed by the elastomeric diaphragm 118. This diaphragm 118 is made of a resilient material that absorbs much of the energy of the pressure waves before they reach adjacent orifices 126. Thus ink will not be ejected from orifices 126 in which an arc was not created.

FIG. 5 illustrates another pressure wave damping mechanism in which the length of each orifice 126 is longer than the embodiment of FIG. 2. Specifically the distance between the electrodes 126 and the ink rail 120 is greater than the distance between the electrodes and the outer surface 128. A constricted section 145 is located in each orifice 126 in close proximity to where the orifice opens into the ink rail 120. The cross-sectional area of the orifice narrows in the constricted section 145, thereby increasing the impedance of the passage to pressure waves. As a result, pressure waves produced when a vapor bubble is created at the electrodes 136 will be impeded from travelling along the orifice and into the ink rail. Constricted sections 145 can be used alone or in conjunction with the elastomeric diaphragm 118.

As noted previously, the print head 110 has approximately 3,400 orifices along its length. Therefore, in order to print a line across the paper, the electrodes 136 in each of the orifices must be biased to create an arc, thereby expelling ink from every orifice. In other situations where individual characters are being printed, ink will be ejected from only selected orifices and therefore the expulsion of ink from each of the orifices must be individually controlled.

Instead of utilizing several thousand switches to individually activate each of the electrodes, the present print head employs a multiplexing scheme via the connection of the individual electrodes 136 to selected buses 132 as shown in FIGS. 2 and 3. The interconnection of the electrodes 136 to the buses 132 may be thought of as a two-dimensional switching matrix with some of the buses being considered rows of the matrix and the remaining buses forming columns of the switching matrix. Each of the buses 132 in the columns of the matrix has an associated switch to connect it to a source of one polarity of voltage while the row buses have similar switches to apply an opposite voltage potential to them. Each intersection of a row and column bus in the switching matrix corresponds to the electrode gap within one of the orifices 126. Thus, one electrode 136 for an orifice is connected to a row bus, whereas the other electrode 136 is connected to a column bus. To create an arc within a specific orifice 126, the switches for its row and column buses are closed to apply a high voltage across the electrode gap, thus creating an arc.

In the particular embodiment of the present invention in which the print head 100 has 3,400 orifices along its length, a 64 by 54 switching matrix can be utilized. As will be apparent to those skilled in the art, other size switching matrices may be utilized. However, conventional integrated circuit drivers are available with 64 outputs enabling two drivers to control a 64 by 54 matrix.

One of the unique attributes of an arc based ink jet system is that a higher voltage potential is required to establish the arc than is necessary to sustain the arc once it has been established. Therefore, a high excitation voltage initially is applied by a driver output to a bus to establish an arc in the desired orifices, and then the drivers can lower the voltage to reduce power consumption while sustaining the arc until the ink droplet is ejected. Thereafter the driver outputs are switched to ground potential to extinguish the arcs. When ink is not to be ejected from an orifice, one of its electrodes 136 is grounded so that even though the excitation voltage may be applied to the other electrode, the voltage across the two electrodes will be significantly below the level necessary to create an arc.

Figure 6:
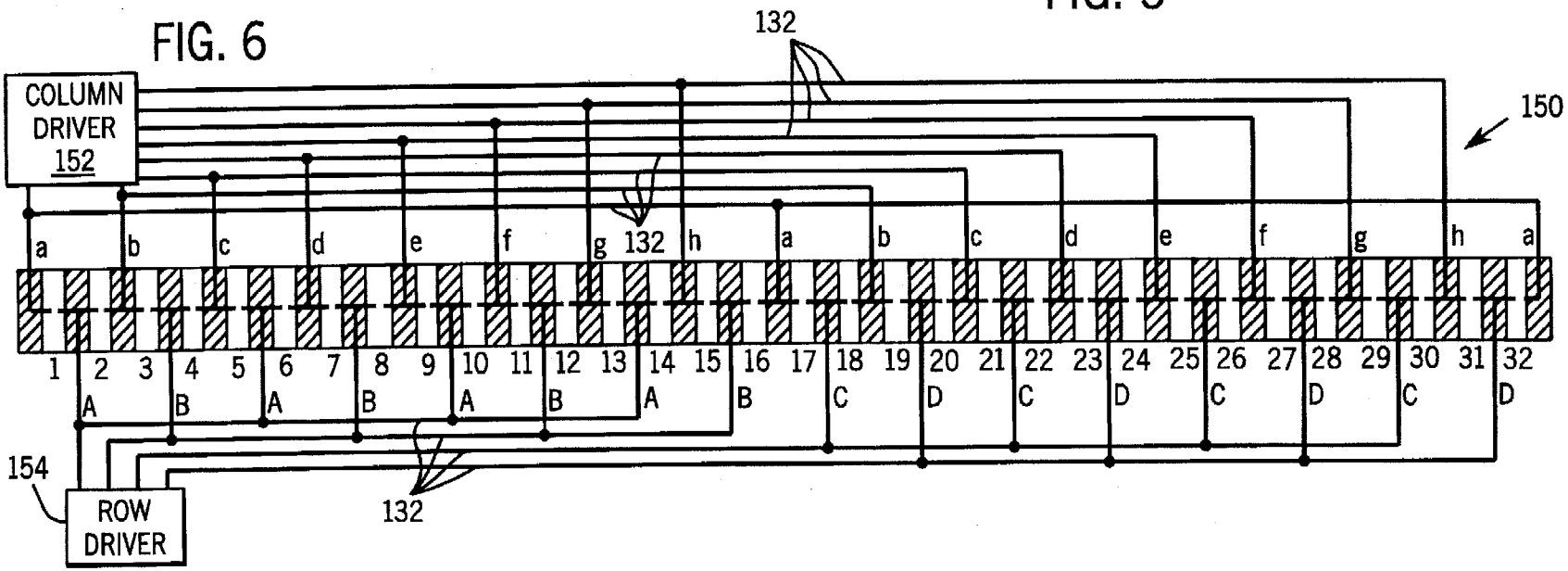
FIG. 6 is a schematic representation of an electrode multiplexing arrangement which can be utilized in the print head.

An exemplary electrode multiplexing technique is illustrated in FIG. 6, although a number of other ways exist. In order to simplify the explanation, a 32 orifice print head is shown with the understanding that the technique can be scaled up for a 3,400 orifice head.

One electrode 136 for each of the orifices is connected to one of eight buses a–h that are coupled to a column driver 152. The other electrode 136 for each orifice is connected to one of four row buses A–D which connect to a row driver 154. As is apparent from the drawing, in order to create an arc in one of the first sixteen orifices, a voltage of one polarity must be applied to the corresponding column bus a–h while the opposite polarity voltage is being applied to the associated row bus A or B. Similarly to create an arc in an orifices numbered 17–32, the appropriate voltages must be applied to one of the column buss a–h and to row bus C or D. For example, to create an arc in orifice 15, the high arc initiation voltage must be applied between column bus h and row bus B.

In practice, the orifices are scanned in a sequential manner which takes into account ionization and deionization times and the ink refill rate. For example, initially a negative excitation potential is applied to row bus A and a positive excitation potential is switched to those column buses a, c, e and g, if ink is desired to be ejected from orifices 1, 5, 9 and 13, respectively. Once the desired arcs have occurred, the voltages are reduced to the sustaining level until sufficient time elapses to insure ejection of ink droplets. These buses a, c, e, g and A then are grounded to extinguish the arcs.

Next the negative excitation potential is applied to row bus B and to those column buses b, d, f, and h as may be desired to eject ink from orifices 3, 7, 11 and 15, respectively. Once the arcs are established the voltage on these buses is reduced to the sustaining level and after droplet ejection, column buses b, d, f, and h are grounded to extinguish the arcs. Then, the high negative excitation potential is reapplied to row bus B, and a high positive excitation potential is coupled only to those column electrodes a, c, d and g as is desired to eject ink from orifices 4, 8, 12, and 16, respectively. Thereafter the sustaining and ground potentials are sequentially switched to these buses.

Finally, the negative excitation potential is applied to row bus A. At the same time, the column buses b, d, f and h have a high positive excitation potential switched to them in order to eject ink from orifices 2, 6, 10 and 14, respectively, as is desired. Then the sustaining voltages are applied to the desired electrodes, followed by grounding to extinguish the arcs.

The arc generation process is repeated for orifices 17–32 using row buses C and D instead of A and B.

Thus, a relatively few number of electrical switches are required with this multiplexing scheme in order to control the expulsion of ink from a much greater number of orifices.

The invention being claimed is:

1. An ink jet print head for applying ink to a material comprising:

a body with a cavity therein and a plurality of grooves spaced along one dimension of said body and extending between the cavity and a surface of said body;

substrate, the plurality of grooves being spaced along the length of said substrate with each groove extending between the trough and another surface of said substrate;

a sheet of non-conductive material against the one surface of the substrate, said sheet having plurality of electrodes arranged so that ends of two different electrodes communicate with each groove, wherein applying a voltage selectively between pairs of the plurality of electrodes produces an arc in each of said grooves, and having a plurality of electrical buses to which the plurality of electrodes connect; and a diaphragm against said sheet and covering the trough and the plurality of grooves, said diaphragm being formed of a resilient material that dampens a pressure wave produced within a groove when an arc occurs between electrodes within that groove.

2. The ink jet print head as recited in claim 1 further comprising a plurality of electrical signal buses extending along the body with each bus being connected to more than one electrode.

3. The ink jet print head as recited in claim 2 further comprising electrical drivers attached to said signal buses to switch different voltages to the plurality of electrodes in order to produce an arc in selected grooves.

4. The ink jet print head as recited in claim 1 wherein each groove in said body has a constricted section in which a cross-sectional area of each groove narrows and the constricted section is located between the cavity and electrodes within each groove.

5. An ink jet print head for applying ink to a material comprising:

a body with a cavity therein and a plurality of orifices spaced along one dimension of said body and extending between the cavity and a surface of said body;

a conduit through which ink is supplied to the cavity;

a plurality of electrodes arranged so that two different electrodes communicate with each orifice to produce an arc in each orifice; and a diaphragm attached to said body forming a wall of the cavity and formed of a resilient material that dampens pressure waves produced in the ink when an arc occurs between electrodes within an orifice.

6. The ink jet print head as recited in claim 5 further comprising a plurality of electrical signal buses extending along the body with each bus being connected to more than one electrode.

7. The ink jet print head as recited in claim 6 further comprising electrical drivers attached to said signal buses to switch different voltages to the plurality of electrodes in order to produce an arc in one of the plurality of orifices.

8. An print head for printing on a material comprising:

a substrate with a length substantially as great as one dimension of the material, and having a trough and a plurality of grooves in one surface of said substrate, the plurality of grooves being spaced along the length of said substrate with each groove extending between the trough and another surface of said substrate;

a sheet of non-conductive material against the one surface of the substrate, said sheet having plurality of electrodes arranged so that ends of two different electrodes communicate with each groove to produce an arc in each groove, and having a plurality of electrical buses to which the plurality of electrodes connect; and a diaphragm against said sheet and covering the trough and the plurality of grooves, said diaphragm being formed of a resilient material that dampens a pressure wave produced within a groove when an arc occurs between electrodes within that groove.

9. The print head as recited in claim 8 further comprising a conduit through which ink is supplied to the trough.

10. The print head recited in claim 8 wherein said sheet of non-conductive material has a first surface on which is formed the plurality of electrodes, and an opposing second surface on which is formed the plurality of electrical buses, and for each electrode a separate groove with a conductive wall extending between that electrode and one of the plurality of buses.

11. The print head as recited in claim 8 wherein there are fewer electrical buses than electrodes and several electrodes are connected to each bus.

12. The print head as recited in claim 8 wherein said sheet has finger sections that extend between adjacent grooves with one of the plurality of electrodes located on each finger section with a portion of the one of the plurality of electrode extending into each of those adjacent grooves.

13. The print head as recited in claim 8 wherein each electrode is has a cross member extending between and into adjacent grooves, and another member coupling the cross member to one of the buses.

14. An ink jet print head for applying ink to a material comprising:

a body having an ink rail cavity and a plurality of orifices located along one surface of said body and extending to the ink rail cavity;

a plurality of electrodes with each electrode extending into two adjacent orifices, said plurality of electrodes divided into a two sets of electrodes wherein each orifice has an electrode from both sets extending to it;

a first group of X electrical signal buses to which one set of said plurality of electrodes connect, where X is plural integer; and a second group of Y electrical signal buses to which another set of said plurality of electrodes connect, where Y is plural integer.

15. The print head as recited in claim 14 wherein each electrical signal bus in said first group is connected to a different group of every Xth electrode in one set; and each electrical signal bus in said second group is connected to every other electrode in a subset of X electrodes in another set.

16. The print head as recited in claim 14 further comprising a diaphragm attached to said body forming a wall of the ink rail cavity, and formed of a resilient material that dampens a pressure wave produced when an arc occurs between electrodes within a groove.

17. An ink jet print head for applying ink to a material comprising:

a body with a cavity containing ink and a plurality of orifices spaced along one dimension of said body and extending between the cavity and a surface of said body;

a conduit through which ink is supplied to the cavity;

a plurality of electrodes arranged so that ends of two different electrodes are within each orifice; and a constricted section between that cavity and electrodes within each one of the plurality of orifices, a cross sectional area of each orifice narrows within the constricted section to provide an impedance which dampens a pressure wave produced when an arc occurs between electrodes within that orifice.

* * * * *